United States Patent [19]

Miconi

[11] 4,029,237

[45] June 14, 1977

[54] SAND SPREADER

[76] Inventor: Pietro Miconi, 78 Aviemore Drive, Weston, Ontario, Canada

[22] Filed: Mar. 20, 1975

[21] Appl. No.: 560,669

[30] Foreign Application Priority Data

May 23, 1974 Canada ..... 200656

[52] U.S. Cl. ..... 222/614; 222/232; 222/313; 222/412

[51] Int. Cl.[2] ..... E01C 19/20

[58] Field of Search ..... 222/177, 231, 232, 233, 222/311, 313, 412; 291/33

[56] References Cited

UNITED STATES PATENTS

| | | | |
|---|---|---|---|
| 875,539 | 12/1907 | Little | 222/177 |
| 2,044,652 | 6/1936 | Walker | 222/177 |
| 2,282,205 | 5/1942 | Olsen | 222/177 |
| 2,631,969 | 3/1953 | Klueger | 222/233 X |
| 2,804,998 | 9/1957 | Kirchmann | 222/177 |
| 3,118,571 | 1/1964 | Reynolds | 222/177 |

*Primary Examiner*—Robert B. Reeves
*Assistant Examiner*—Frederick R. Handren

[57] ABSTRACT

A spreader is described, primarily for use in distributing sand and the like on ice and snow-covered sidewalks. The spreader has a frame supported on ground wheels and a sand hopper is provided on the frame. An auger is mounted at a lower end of the hopper in an opening in the hopper to control the flow of sand from the spreader. A driving wheel is operably coupled to the auger, and supported on the hopper for movement between an operative position in which the wheel is in peripheral driving engagement with one of the ground wheels and an inoperative position in which the driving wheel is clear of this ground wheel. In the operative position the auger is driven as the spreader moves along the ground to spread sand and in the inoperative position the driving wheel is disengaged from the ground wheel and the auger is stationary.

8 Claims, 6 Drawing Figures

SAND SPREADER

This invention relates to an apparatus which may be used to spread sand, gravel, and chemicals such as salt on snow and ice-covered paths, sidewalks and other pedestrian thoroughfares. For convenience of description, such an apparatus will be referred to as a sand spreader.

Sand spreaders conventionally comprise a hopper carried by a frame which has two ground wheels on a common axle adjacent its rear end. A towing bracket is provided at the front end of the frame so that the spreader can be towed behind a ractor. Sand is dispensed from the hopper by a rotary auger which is positioned in the bottom of the hopper and is driven in rotation from one of the ground wheels.

Sand spreaders are normally used on sidewalks. It is therefore desirable for the track of the ground wheels to be such as to allow the spreader to be used on normal width sidewalks, concomitant with a hopper which is of maximum width to acommodate a maximum amount of sand.

Accordingly, there is provided a sand spreader having a frame supported on wheels for movement over the ground in use. A sand hopper is mounted on the frame and has an opening at its lower end through which sand can be dispensed. A rotary auger is carried by the hopper and is positioned in said opening to control the flow of sand from the hopper. The auger is driven by a driving wheel which is coupled to the auger and is mounted for movement between an operative position in which the wheel is in peripheral driving engagement with one of the ground wheels, and an inoperative position in which the driving wheel is clear of this ground wheel. In the operative position the driving wheel transmits torque from the moving ground wheel to the auger as the spreader is pulled along, whereas in the inoperative position the auger is stationary.

In other words, in the sand spreader according to the invention, the auger is driven by a friction drive from one of the ground wheels. Consequently, the hopper can be of maximum width concomitant with a spacing between the ground wheels which allows the spreader to be conveniently used on sidewalks of normal width.

A further advantage of friction drive is that it can slip in the event that the auger becomes jammed due to the presence of a stone or other foreign material in the sand. A conventional chain and sprocket drive has no provision for slip; accordingly, if the auger does jam, damage to the drive mechanism is almost inevitable.

The invention will be better understood by reference to the drawings, wherein.

Figures 1, 2:
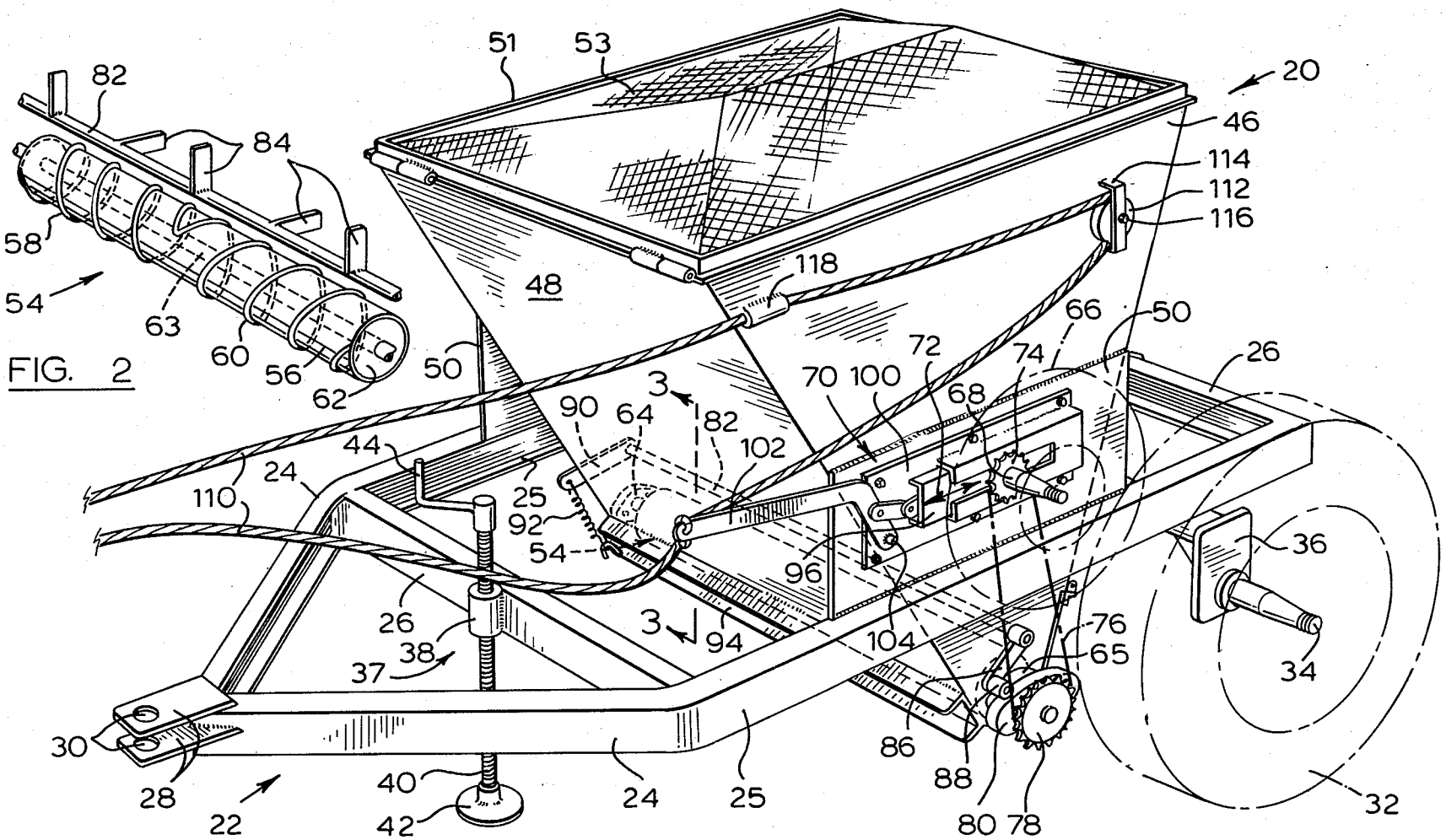
FIG. 1 is a perspective view from the front and one side of a sand spreader in accordance with the invention.
FIG. 2 is a perspective view of the auger used in the sand spreader of FIG. 1.

Referring firstly to FIG. 1, the sand spreader basically comprises a sand hopper 20 mounted on a frame 22 adapted to be towed behind a tractor or the like. Frame 22 has a pair of side members 24 which are of channel shape in cross section and each of which includes a straight portion 25. A pair of transverse members 26 which are of similar cross-section extend between the ends of the straight portions 25. At the left hand end of the frame in FIG. 1, the side members 24 extend beyond the relevant transverse member 26, and are inwardly inclined and joined directly together at their ends to form a triangular leading end portion of the frame. A pair of vertically spaced horizontal plates 28 provided at the junction between the side members 24 and are formed with vertically aligned holes 30 to receive a link pin of a tractor hitch (not shown).

The frame is supported for movement over the ground by a pair of main ground wheels 32 (only one of which is visible in FIG. 1). Each wheel 32 is mounted on a fixed stub axle 34 carried by reinforced L-shaped bracket 36 welded to the underside of the relevant frame member 24 adjacent its rear end.

A stand 37 is provided to enable the frame to be supported in a horizontal disposition when the sand spreader is not in use. The stand includes a cylindrical sleeve 38 welded to the front transverse member 26 of the frame. Sleeve 38 is arranged with its axis vertical and is internally threaded to receive a threaded spindle 40. A foot 42 is provided at the lower end of the spindle and a handle 44 on the spindle upper end facilitates rotating the threaded spindle to adjust the vertical position of the sleeve 38 and hence the height of the front end of the frame 22. After the spreader has been hitched to a tractor, the spindle 40 must be screwed upwards by an amount sufficient to ensure that the foot 42 clears the ground.

As can be seen the hopper 20 is of triangular shape in side view, comprising a pair of parallel, triangular side plates 46 and a pair of end plates 48 which are welded between the side plates 46 along their inclined edges. The hopper 20 includes a pair of rectangular plates 50 which are welded one to each side of the hopper. Each plate 50 is also welded to the corresponding side member 24 of the frame along its bottom edge.

A peripheral frame 51 is hinged to the top edge of the front end plate 48 of hopper 20 and has a wire mesh cover 53 to prevent large stones and other foreign material entering the hopper.

Figure 3:
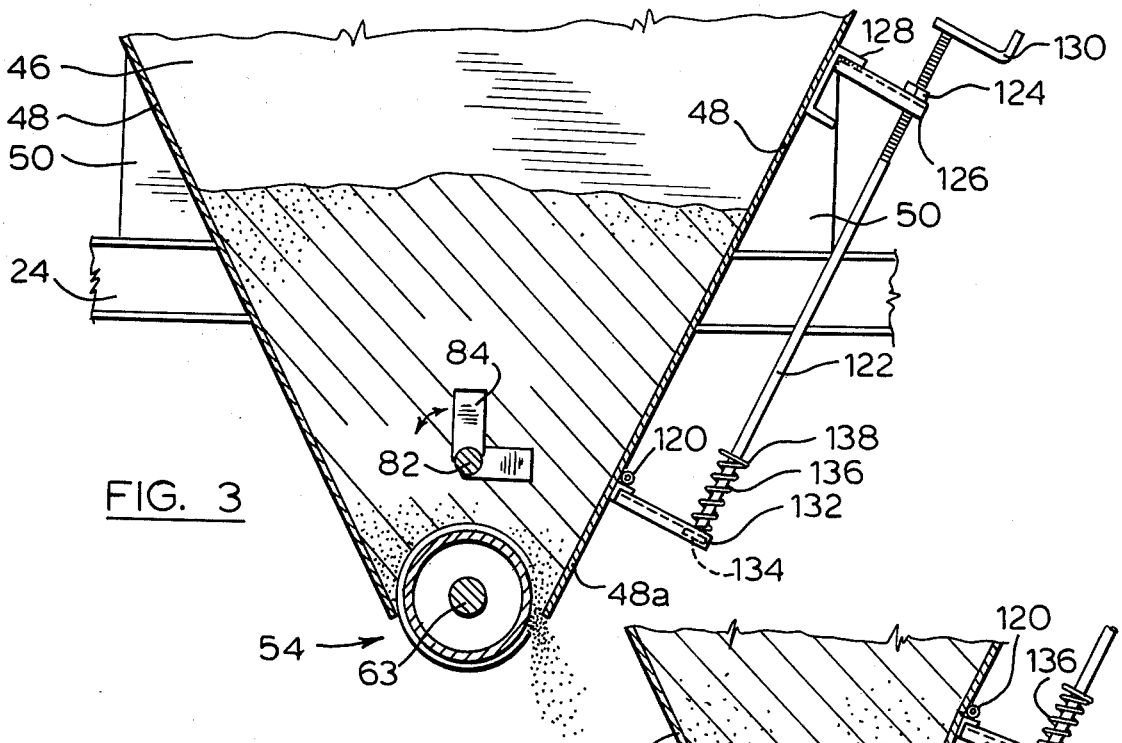
FIG. 3 is a vertical sectional view on line 3—3 of FIG. 1.
Figure 6:
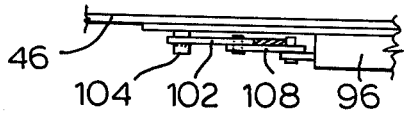
FIG. 6 is a transverse sectional view on line 6—6 of FIG. 5.

As can best be seen in FIG. 3, each hopper side plate 46 has a part circular cutout 52 at its bottom end to accommodate a rotary auger 54 of generally cylindrical form. It will be noted that the lower edges of the end plates 48 of the hopper are disposed adjacent the external surface of the auger 54 so that the latter projects slightly below the bottom of the hopper 20.

In FIG. 1, the auger 54 is visible in the bottom of the hopper 20, being shown in broken outline. To facilitate understanding of the structure of the auger, it is also shown in FIG. 2 removed from the hopper. The auger comprises a pipe 56 having tack welded thereto, two sections of 1/4 inch diameter rod 58, 60 arranged in respectively opposite handed helical paths on the external surface of the pipe 56. Viewed from the position of FIG. 1, rod 60 is arranged to define a left-handed helix and rod 58 a right-handed helix.

Each end of pipe 56 is closed by a disc member 62 having a central aperture to receive a spindle 63 which extends axially of pipe 56. One end of spindle 63 is mounted in a closed bearing 64 inside the hopper 20 of the sand spreader whilst the other end of rod 64 extends through a second bearing 65 and projects to the outside of the hopper, as can be seen in FIG. 1. Drive means (to be described) engages the projecting end of spindle 63 and rotates the auger unidirectionally in use to deliver sand from the hopper 20. The provision on the auger of opposite handed helical blades (formed by the rods 58, 60) has the result that sand tends to be conveyed inwardly from the ends of the auger towards its centre to distribute the sand. Further, it avoids the need for a thrust bearing at one end of the auger spindle.

Figure 5:
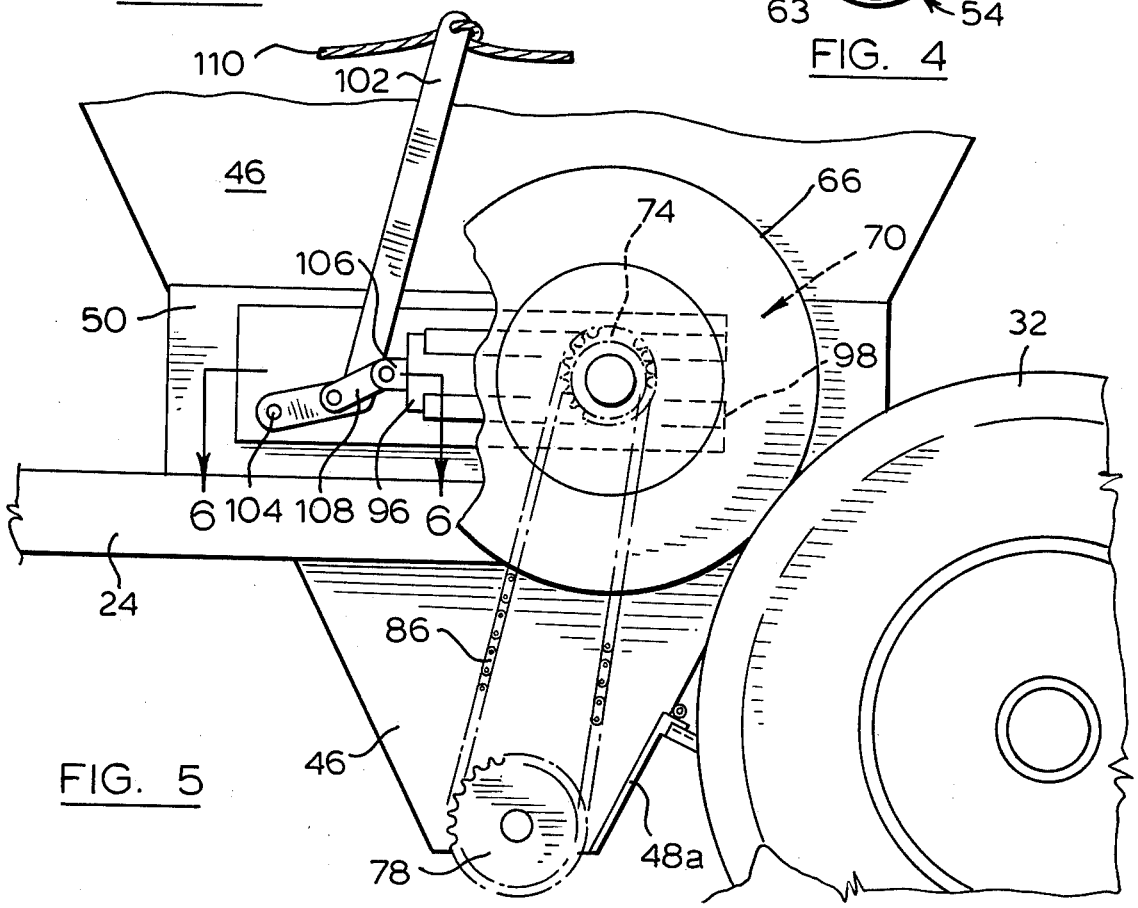
FIG. 5 is a partial view of the side of the spreader shown in FIG. 1.

The drive for the auger is taken from the main ground wheel 32 shown in FIG. 1 to the auger by way of a driving wheel 66. For convenience of illustration in FIG. 1, both the wheel 32 and the driving wheel 66 are shown in ghost outline. In practice, each of these wheels carries a pneumatic rubber tire as indicated in FIG. 5. The driving wheel 66 is mounted on a stub axle 68 carried by a slide mechanism which is generally designated 70 and which will be more specifically described later. At this stage it is sufficient to say that the slide mechanism is movable horizontally in the direction of arrow 72 in FIG. 1 to move the wheel 66 between an "on"position in which wheel 66 is in peripheral driving contact with the ground wheel 32 and an "off"position in which wheel 66 is clear of wheel 32.

The stub axle 68 is parallel to the spindle 63 and carries the wheel 66 which is rotatably mounted on mechanism 70. The axle also carries a sprocket 74 which is coupled to rotate with wheel 66. The sprocket 74 is at the inner end of axle 68 and is drivably coupled to the auger 56 by an endless chain 76 which engages both sprocket 74 and a second sprocket 78 mounted on the projecting outer end of the auger spindle 63. When the driving wheel 66 is in its right hand position in FIG. 1, therefore, auger 54 will be driven in rotation by way of the sprockets 74, 78 and chain 76. However, when wheel 66 is in its left hand position out of peripheral engagement with wheel 32, the drive will be disengaged and auger 54 will be stationary.

The projecting outer end of spindle 63 carries an elliptical cam positioned inwardly of sprocket 78 and arranged to drive an agitator mechanism. This mechanism comprises a shaft 82 which extends parallel to the spindle 63 of auger 54, and which is shown both in broken outline inside the hopper 20 in FIG. 1 and in full outline at the top left-hand corner of FIG. 1, above auger 54. Shaft 82 has welded thereto a number of longitudinally spaced rectangular projections 84 arranged in two groups, the projections in the respective groups being positioned at right angles to one another. As can be seen, in this particular embodiment, there are three vertical projections 84 and two horizontal projections. Shaft 82 extends through the hopper, its opposite ends projecting through the respective side plates 46. The end of shaft 82 adjacent cam 80 is provided with a radial arm 86 which has a cam follower 88 at its outer end arranged to roll on the edge of cam 80. The opposite end of shaft 82 carries a further radial arm 90 which is biased downwardly by a spring 92 connected between the outer end of arm 90 and a channel member 94 welded across the lower margin of the left-hand end plate 48 of hopper 20 in FIG. 1. Spring 92 therefore tends to turn shaft 82 in the counter-clockwise direction in FIG. 1 so as to maintain the cam follower 88 on the edge of cam 80.

The elliptical of cam 80 causes the unidirectional rotation of the spindle 63 of auger 54 to impart to the agitator, an oscillatory motion about the axis of shaft 82. This will tend to agitate and break up the sand in hopper 20 immediately before the sand reaches the auger 54. This oscillatory motion of the agitator is preferred to a rotary motion as is found in conventional sand spreaders, as rotary agitators tend to preform a mixing action which, if the sand is wet, can lead to the formation of mortar in the bottom of the hopper.

The construction of the mechanism 70 which carries the drive wheel 66 referred to above will now be described in more detail:

The mechanism comprises a horizontally movable slide 96 which is received in a guide 98, mounted on a base plate 100 which is bolted to the side of hopper 20. Slide 96 carries the rotatable stub axle 68 referred to above. Movement of slide 96 is controlled by a cranked operating lever 102, which is pivotally connected to the base plate 100 by a pivot pin 104. Slide 96 is connected to the operating lever 102 by way of a lug 106 on the outer end of the slide (see FIG. 4) which is pivotally connected to one end of an intermediate link 108, the opposite end of which is pivoted to lever 102. Lever 102 is movable about its pivot between the "off"position in which it is shown in FIG. 1 and the "on"position in which it is shown in FIG. 3. In the "off"position, slide 96 is drawn to the left in FIG. 1 by the intermediate link 108. If lever 102 is moved to the right in FIG. 1 about its pivot, it will cause the slide 96 to move to the right and cause the intermediate link 108 to go over-centre and lock the slide 96 in the right-hand position in which driving wheel 66 is in peripheral engagement with ground wheel 32. This over-centre locking action occurs because the pivot point between the intermediate link 108 and lever 102 is below the line joining pivot pin 104 and the pivotal connection of the other end of link 108 to lug 106.

As has already been mentioned, the sand spreader shown in the drawings is intended to be towed behind a tractor or the like. To enable the tractor driver to operate the mechanism 70 from his driving seat, the outer end of lever 102 has an aperture through which is threaded a rope 110 formed with a knot to prevent it slipping through the aperture. From lever 102, the rope 110 extends rearwardly of the frame and around a pulley 112, rotatably mounted on the hopper side plate 46 which carries mechanism 70. Pulley 112 is secured to the hopper by a bracket 114 and bolt 116 on which the pulley turns. From pulley 112, the rope again extends forwardly of the sand spreader through a horizontal guide sleeve 118 welded to side plate 46. Both ends of rope 110 are lead forwardly from the sand spreader to the tractor by which it is towed and are, for example, tied to a convenient part of the tractor so that they are within easy reach of the driver. However, care must be taken to ensure that there is sufficient slack in the rope to prevent it being accidentally pulled as the tractor moves relatively to the spreader. Considering the slide mechanism 70 to be in the position in which it is shown in FIG. 1 (i.e., the "off"position), the tractor driver pulls on the top run of the rope to turn the operating lever 102 of mechanism 70 in the clockwise direction, thereby bringing the driving wheel 66 into engagement with wheel 32 to establish a drive train from that wheel to the auger 54 and to the agitator. The auger will then rotate and the agitator oscillate to dispense sand through the bottom of hopper 20. To stop sand being dispensed, the tractor driver pulls on the bottom run of rope 110 to move lever 102 in the counter-clockwise direction and thereby disengage wheel 66 from wheel 32.

In order to allow variation in the rate at which sand is dispensed from the spreader, the rear end plate 48 of hopper 20 is provided with a hinged lower portion 48*a*(see FIG. 3), the position of which can be adjusted to vary the width of the gap between its bottom edge and the auger 54. In FIG. 3 the hinge between plate 48 and portion 48*a*is visible in end view at 120; it will be seen that a piano type hinge is employed. The position of the flap-forming portion 48*a*of plate 48 is controlled by a rod 122 mounted parallel to plate 48. Rod 122 is screw-threaded adjacent its upper end, the screw-threaded portion passing through a nut 124 welded to a bracket 126 which projects outwardly from plate 48. In fact bracket 126 is itself welded to a channel member 128, welded to plate 48. At its upper end, rod 122 has a handle 130 by which the rod can be turned to vary its axial position by virtue of the screw-threaded connection to bracket 126.

The lower end of rod 122 passes through an aperture formed in an arm 132 which projects from portion 48*a* of plate 48 at right angles thereto. The bottom end of rod 122 is provided, below the arm 132, with a washer 134 which abuts the bottom face of arm 132. A compressing spring spring 136 washer 134 in contact with arm 132, the spring extending between the arm and a second washer 138 welded to the rod.

Figure 4:
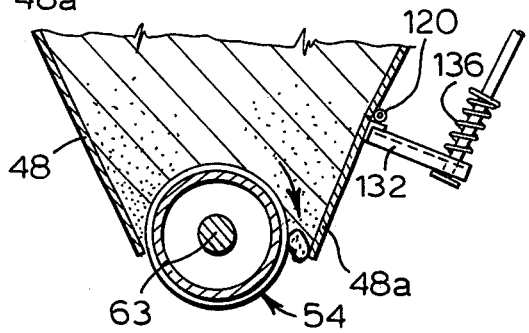
FIG. 4 is a detail of part of FIG. 3 showing the effect of a stone passing through the sand spreader.

It will be appreciated that, by turning rod 122 by means of handle 130, the gap between the flap-forming portion 48*a* of plate 48 and the auger can be increased or decreased, depending on the direction in which the rod is turned. It will further be appreciated that the connection between rod 122 and portion 48*a* is such that the latter can hinge outwardly against the action of spring 136 (see FIG. 4), in the event that a stone or other obstruction is present in the sand being dispensed by auger 54. In FIG. 4 a stone indicated at 140 has been carried around by the auger and would jam between the latter on the side of the hopper were it not for the spring biased connection referred to above which allows the flap-forming portion 48*a* to hinge outwardly and release the stone.

When the sand spreader is to be used, hopper 20 is filled with sand to an appropriate level and, with the spreader hitched to a tractor, as described above, it is towed, for example, along a sidewalk. When the tractor driver wishes to dispense sand, he pulls on the upper run of rope 110 to bring wheel 66 into contact with wheel 32 so that the auger 54 and agitator commence operation. Accordingly, sand is dispensed from hopper 20 across the whole length of auger 54, the sand being distributed inwardly by the auger as described above. If it appears that the quantity of sand being dispensed is incorrect, the rate of sand flow can be adjusted by turning rod 122 by means of handle 130 (FIG. 3) to vary the gap at the delivery side of the auger. When the driver has finished his sanding run, he simply pulls on the lower run of rope 110 to return mechanism 70 to its inoperative position with wheel 66 clear of wheel 32 and the delivery of sand will cease as auger 54 comes to rest.

What I claim is:

1. A sand spreader comprising:

a frame;

ground wheels coupled to and supporting the frame for movement over the ground in use;

a sand hopper mounted on the frame and having an opening at its lower end through which sand can be dispensed;

a rotary auger mounted in the hopper and positioned in said opening therein for controlling the flow of sand from the hopper in use; and, a driving wheel which is drivably coupled with the auger;

a slide supporting the driving wheel for movement between an operative position in which the wheel is in peripheral engagement with one of the ground wheels supporting the frame of the spreader, whereby rotation of that ground wheel as the spreader moves over the ground in use drives the auger by way of the driving wheel, and an inoperative position in which the driving wheel is clear of the relevant ground wheel;

a lever for moving the slide between a first position in which the driving wheel is in its said operative position and a second position in which the driving wheel is in its said inoperative position; and, an over-centre linkage coupling the lever to the slide, said linkage being adapted to lock the slide in said first position when the lever is moved in the appropriate direction.

2. A sand spreader according to claim 1, wherein the auger, driving wheel and ground wheels rotate about parallel axes and wherein the spreader further comprises a chain and sprocket drive drivably coupling the driving wheel to the auger, said drive comprising a first sprocket mounted to rotate with the driving wheel, a second sprocket mounted to rotate with the auger, and an endless chain coupling the sprockets.

3. A sand spreader as claimed in claim 1, further comprising rubber tires on the ground wheels and driving wheel.

4. A sand spreader as claimed in claim 1, wherein the auger comprises a cylindrical tube, and two blades of opposite-handed helical form secured to the external surface of the tube, whereby rotation of the auger in the appropriate direction in use tends to convey sand inwardly of the auger towards its centre.

5. A sand spreader as claimed in claim 1, further comprising: an agitator positioned in the hopper above the auger to agitate the sand before it reaches the auger, and a cam which is coupled to the auger and is adapted to drive the agitator in an oscillatory motion.

6. A sand spreader as claimed in claim 5 wherein the auger is mounted on a spindle driven from said auger drive means, wherein said cam driving the agitator is mounted on said spindle, and wherein the agitator comprises: a shaft mounted on said spindle; a plurality of radial agitator projections on said shaft; a radial arm on said shaft positioned to contact the edge of said cam; and biasing means adapted to maintain said arm and cam in contact.

7. A sand spreader as claimed in claim 1, wherein a part of the hopper wall which defines the opening receiving the auger is initially separate from the remainder of said wall and is hinged thereto about an axis parallel to the axis of the auger, and wherein the spreader further comprises biasing means adapted to maintain said part of the hopper wall in a normal position in which a predetermined space is defined between said part and the auger, whereby a piece of foreign material passing between the auger and said part of the wall can hinge said part outwardly against the biasing means and so pass safely through the hopper opening, the biasing means subsequently returning said part of the hopper wall to its normal position.

8. A sand spreader as claimed in claim 7, further comprising means for adjusting the normal position of said part of the hopper wall to vary the spacing between said wall and the auger, and thereby to control the rate of sand flow from the hopper.

* * * * *